US011980930B2

(12) United States Patent
Cao et al.

(10) Patent No.: US 11,980,930 B2
(45) Date of Patent: May 14, 2024

(54) SUPPORT UNIT AND CONTINUOUS CASTING GUIDE ROLL ASSEMBLY INCLUDING SAME

(71) Applicant: AKTIEBOLAGET SKF, Gothenburg (SE)

(72) Inventors: Weiguang Cao, Changshu (CN); Jiakai Liu, Shanghai (CN); Zongkang Xu, Suzhou (CN); Weifei Geng, Shanghai (CN)

(73) Assignee: AKTIEBOLAGET SKF, Gothenburg (SE)

( * ) Notice: Subject to any disclaimer, the term of this patent is extended or adjusted under 35 U.S.C. 154(b) by 0 days.

(21) Appl. No.: 18/196,221

(22) Filed: May 11, 2023

(65) Prior Publication Data

US 2023/0381854 A1 Nov. 30, 2023

(30) Foreign Application Priority Data

May 31, 2022 (CN) ..... 202210609418.7

(51) Int. Cl.
*B22D 11/06* (2006.01)
*B22D 11/07* (2006.01)
*B22D 11/128* (2006.01)

(52) U.S. Cl.
CPC ..... *B22D 11/0628* (2013.01); *B22D 11/07* (2013.01)

(58) Field of Classification Search
CPC ..... B22D 11/06; B22D 11/0628; B22D 11/07; B22D 11/128; B22D 11/1287
USPC ..... 164/441, 442, 447, 448, 428
See application file for complete search history.

(56) References Cited

U.S. PATENT DOCUMENTS

2012/0043047 A1* 2/2012 Springmann et al. ..... B22D 11/1287 164/442
2022/0373034 A1 11/2022 Isozaki et al.

FOREIGN PATENT DOCUMENTS

| | | | |
|---|---|---|---|
| JP | H09177797 | A | 1/1997 |
| JP | 2004148407 | A | 5/2004 |
| JP | 2006118600 | A | 5/2006 |
| JP | 2008196510 | A | 8/2008 |
| WO | 2021054426 | A1 | 3/2021 |

OTHER PUBLICATIONS

Office Action from the Austrian Patent Office dated Oct. 20, 2023 in related application No. A 50323/2023, and machine translation thereof.
Translation of Search Report from the Austrian Patent Office dated Oct. 19, 2023 in related application No. A 50323/2023.

* cited by examiner

*Primary Examiner* — Kevin P Kerns
(74) *Attorney, Agent, or Firm* — J-TEK LAW PLLC; Scott T. Wakeman; Mark A. Ussai

(57) ABSTRACT

A support unit for a roll shaft of a continuous casting guide roll includes a housing having first axial end face, a second axial end face and a through-opening extending from the first axial end face to the second axial end face, a first cover connected to the first axial end face, a first primary isolator arranged radially between the first cover and the roll shaft, and a bearing in the through opening. On a first side of the bearing, a first closed space is partially defined by the bearing, the first cover and the first primary isolator, and the first closed space is pre-filled with a lubricant.

15 Claims, 3 Drawing Sheets

SUPPORT UNIT AND CONTINUOUS CASTING GUIDE ROLL ASSEMBLY INCLUDING SAME

CROSS-REFERENCE

This application claims priority to Chinese patent application no. 202210609418.7 filed on May 31, 2022, the contents of which are fully incorporated herein by reference.

TECHNOLOGICAL FIELD

The present disclosure relates to a support unit and a continuous casting guide roll assembly including the support unit.

BACKGROUND

Continuous casting is an important processing technology for large castings. The continuous casting process involves the use of a continuous casting machine. Referring to FIG. 1, in the continuous casting process of a continuous casting machine, molten metal flows into a crystallizer (mold) 1*c* from a ladle 1*a* and a tundish 1*b*, and then solidifies on the water-cooled crystallizer wall to form a solid housing. This housing containing liquid metal is called a slab 1*d*, which is continuously taken out from the bottom of the crystallizer. The slab 1*d* is supported by a plurality of closely spaced water-cooled continuous casting guide rolls (also called continuous casting rolls) 1*e*, and the roll lines 1*e* are used to support the outer wall of the slab 1*d* against the ferrostatic pressure of the still-solidifying liquid in the slab 1*d*. In order to improve the rate of solidification, the slab 1*d* is sprayed with water and air mist. The surface temperature of the slab 1*d* usually exceeds 850° C.

In different stages of the casting process, the roll lines 1*e* support and guide the slab 1*d* in a rotating or standstill manner, and the continuous casting guide rolls are internally provided with bearings and bearing seats via which the continuous casting guide rolls are carried on the continuous casting guide roll frame. The guide rolls are carried on the frame of the continuous casting machine. Support modules located at different parts of the roll lines 1*e* are exposed to direct thermal radiation, high temperature, large amount of steam and high humidity from the slab 1*d*. In addition, pollutants such as scale, dust and fogging from the surface of slab 1*d* may invade the support modules. Therefore, the lubricant quality of the rolling bearings in the support modules will quickly degrade, and this can lead to bearing failure which adversely affects the support.

In order to alleviate the above shortcomings of continuous casting guide rolls, a common solution is to provide a roll line assembly. It is generally believed that due to the volume, weight and working environment of the continuous casting guide rolls, the lubricant should be continuously supplied to the bearings in the roll lines through a centralized lubrication system so that the lubricant in the support modules can be extracted as waste and refilled in a short time to ensure the continuous and stable operation of the continuous casting guide rolls. Another common solution is to additionally provide a centralized lubrication system in the workshop of continuous casting production, which frequently supplies additional lubricant to the bearings inside the continuous casting guide rolls through long-distance pumping pipelines and discharges the original lubricant to the outside of the continuous casting guide rolls. However, this solution continuously consumes a lot of lubricant and pollutes the casting equipment and maintenance site, and it is difficult to collect and handle the waste lubricants.

In addition, in order to protect the bearings, conventional radial inner lip seals are usually used to block the scale and water on the surface of the roll shaft from entering the bearing. However, this conventional sealing method can't effectively prevent water, steam and pollutants from invading at the fit clearance between the components of the support modules, and the lubricant will still be contaminated. Therefore, it is more necessary to pump and refresh the lubricant through the centralized lubrication system, and the consumption of lubricant is increased further.

SUMMARY

In view of the problems and requirements mentioned above, the present disclosure proposes a new technical solution, which solves the above problems and brings other technical effects by adopting the following technical features.

The present disclosure provides a support unit for a roll shaft of a continuous casting guide roll that comprises a housing having an inner hole, a first axial end face and a second axial end face opposite the first axial end face; a first cover connected to the first axial end face of the housing; and a first isolator arranged between the first cover and the roll shaft. The bearing is arranged in the inner hole of the housing and lubricant which is pre-filled and enclosed in the support unit is arranged between the bearing and the first isolator.

The present disclosure also provides a continuous casting guide roll assembly that includes at least one support unit as described above.

According to the technical solution disclosed by the invention, the common perception that "the lubricant must be continuously supplemented and updated" in the prior art is overcome, the structure of the support unit is simplified, and the usage of lubricant is greatly reduced. Therefore, compared with the prior art, the support unit according to the present disclosure is particularly suitable for use in harsh environments such as continuous casting application, and the support unit has a longer service life and lower industrial waste discharge.

BRIEF DESCRIPTION OF THE DRAWINGS

In order to explain the technical solution of the embodiment of the present disclosure more clearly, the attached drawings of an embodiment of the present disclosure will be briefly introduced below. Among them, the drawings are only used to show some embodiments of the present disclosure, and are not limited to all embodiments of the present disclosure.

DETAILED DESCRIPTION

Figure 1:
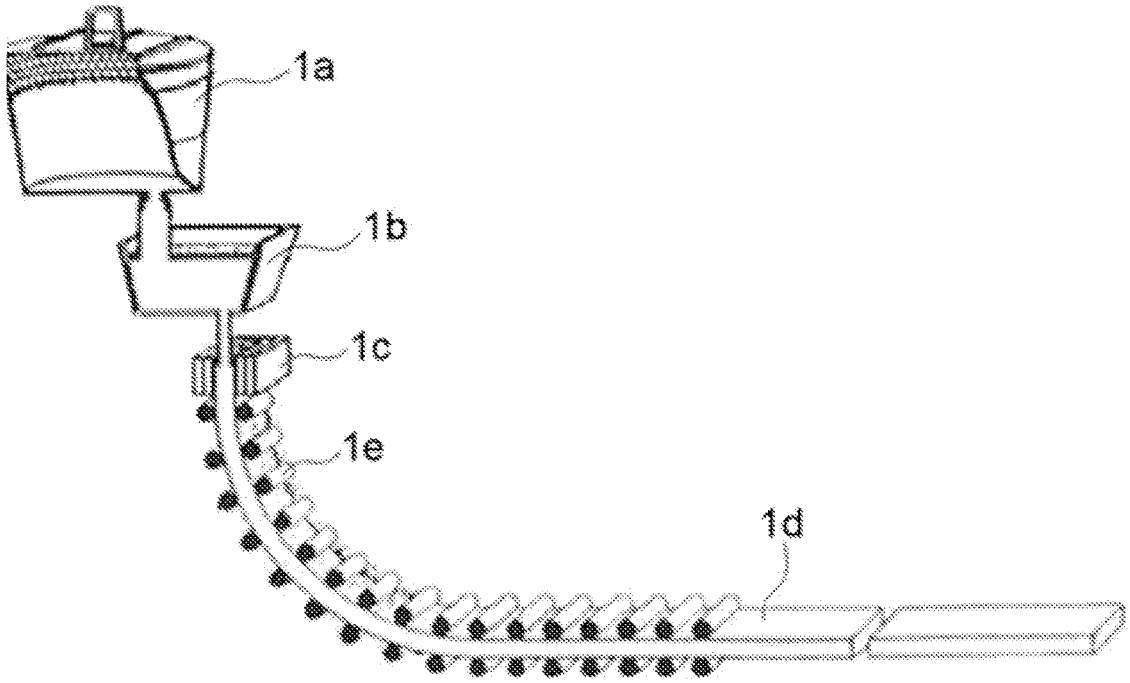
FIG. 1 is a schematic diagram of continuous casting equipment.

In order to make the purpose, technical solution and advantages of the technical solution of the present disclosure more clear, the technical solution of the embodiment of the present disclosure will be described clearly and completely with the accompanying drawings of specific embodiments of the present disclosure. Like reference numerals in the drawings represent like parts. It should be noted that the described embodiment is a part of the embodiment of the present disclosure, not the whole embodiment. Based on the described embodiments of the present disclosure, all other embodiments obtained by ordinary people in the field without creative labor belong to the scope of protection of the present disclosure to the extent they fall within the scope of the several claims appended hereto.

Compared with the embodiment shown in the drawings, the feasible embodiments within the protection scope of this disclosure may have fewer components, other components not shown in the drawings, different components, components arranged differently or components connected differently, etc. Furthermore, two or more components in the drawings may be implemented in a single component, or a single component shown in the drawings may be implemented as a plurality of separate components.

Unless otherwise defined, technical terms or scientific terms used herein shall have their ordinary meanings as understood by people with ordinary skills in the field to which this disclosure belongs. The words "first", "second" and similar words used in the specification and claims of the patent application of this disclosure do not indicate any order, quantity or importance, but are only used to distinguish different components. When the number of parts is not specified, the number of parts can be one or more. Similar words such as "a/an", "the" and "said" do not necessarily mean quantity limitation. Similar words such as "including" or "containing" mean that the elements or objects appearing before the word cover the elements or objects listed after the word and their equivalents, without excluding other elements or objects. Similar words such as "installation", "setting", or "connection" are not limited to physical or mechanical installation, setting and connection, but can include electrical installation, setting and connection, whether directly or indirectly. "up", "down", "left" and "right" are only used to indicate the relative orientation relationship when the equipment is used or the orientation relationship shown in the attached drawings. When the absolute position of the described object changes, the relative orientation relationship may also change accordingly.

For convenience of explanation, the direction of the axis of rotation of the roll shaft, bearing, etc. is called the axial direction, and the direction perpendicular to the axial direction is called the radial direction. The term "inner/inward" refers to the direction toward the inside of the related component, and on the contrary, the term "outer/outward" refers to the direction toward the outside of the related component.

Figure 2:
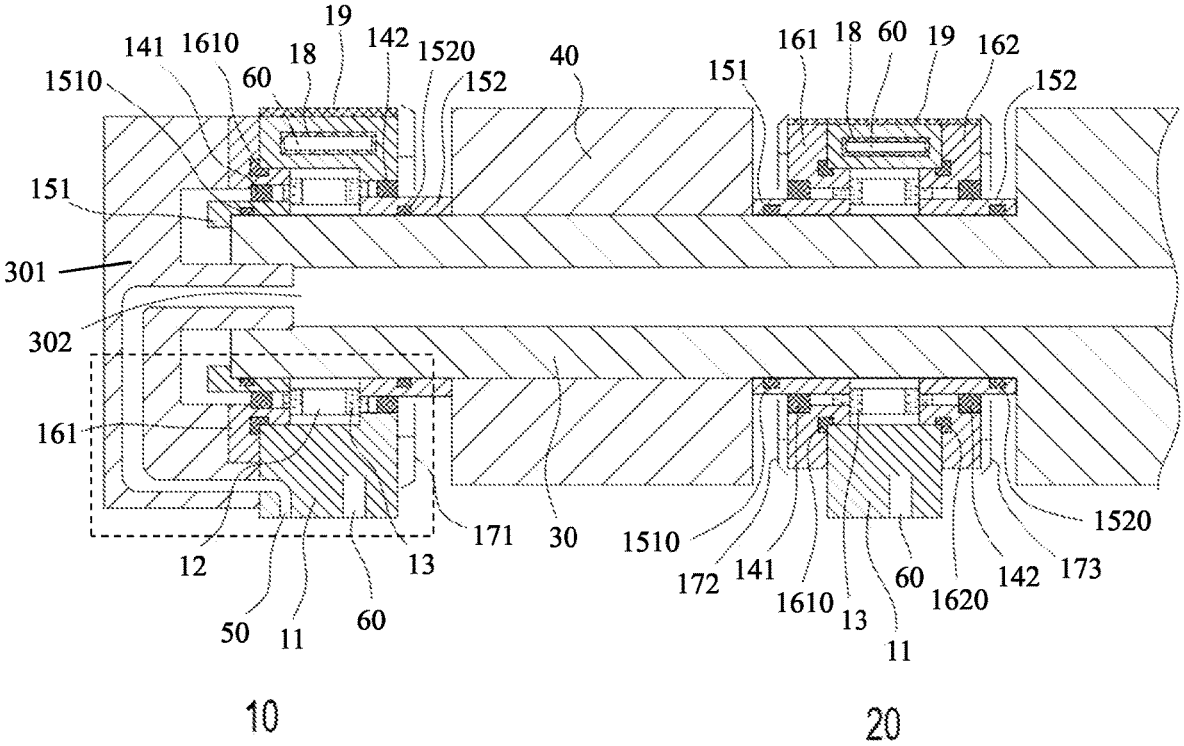
FIG. 2 is a schematic view of a continuous casting guide roll assembly equipped with a support unit according to the present disclosure.

FIG. 2 shows a support unit for a roll shaft 30 of a continuous casting guide roll 1*e*. Further, FIG. 2 shows two different structures for the support unit according to the present disclosure, namely, a support unit 10 and s support unit 20. It should be understood that these two structures can be used in suitable situations as required. The support unit according to the present disclosure will be described below by taking the support unit 10 as an example.

Referring to FIGS. 2-5, the support unit 10 includes a housing 11, a first cover 161, a first isolator 141 (a first primary isolator), a bearing 12, and lubricant 13 filled in advance and enclosed in the support unit.

Figure 3:
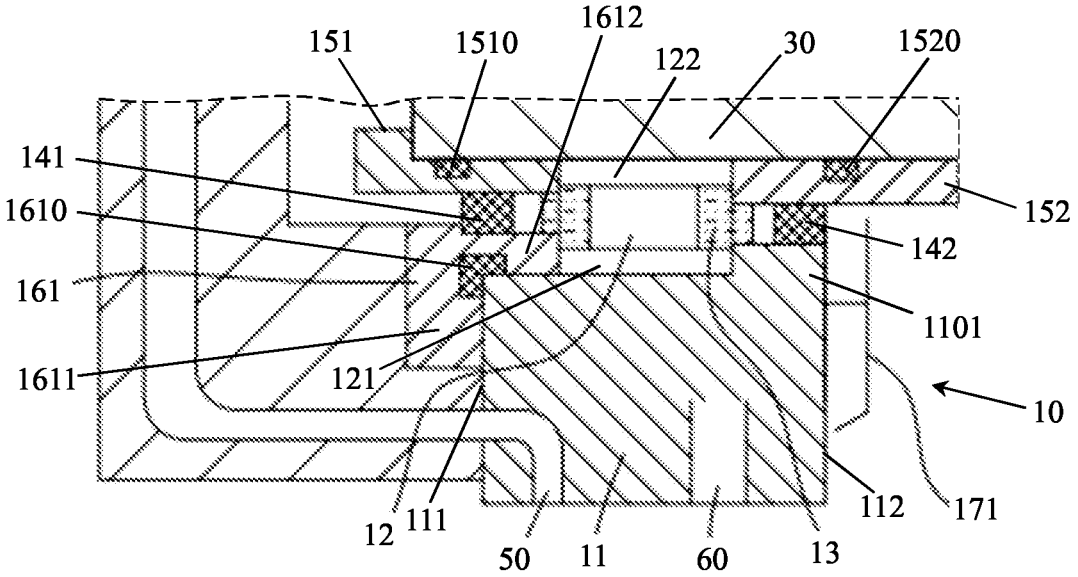
FIG. 3 is a partial enlarged view of a preferred embodiment of a support unit according to the present disclosure.
Figure 4:
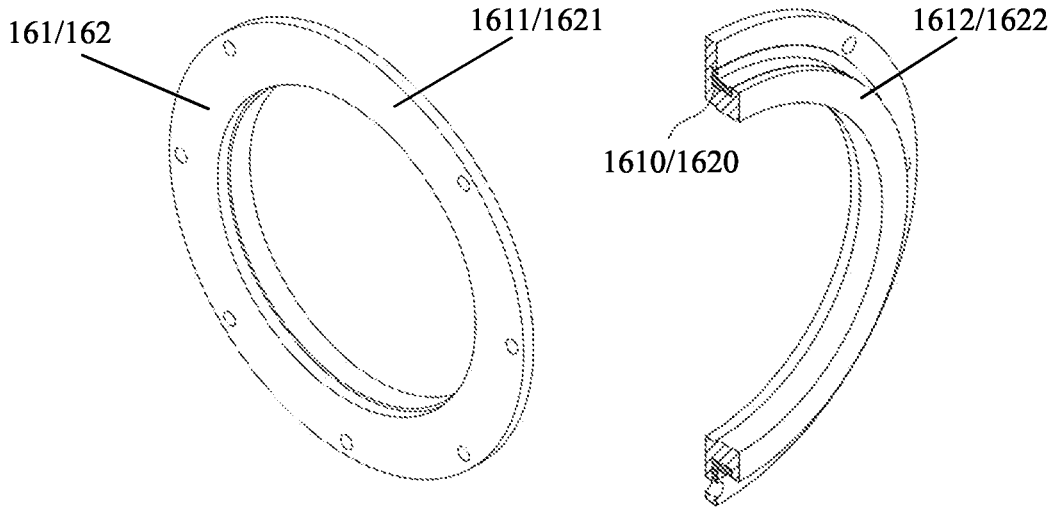
FIG. 4 is a schematic view of a preferred embodiment of the first cover/second cover according to the present disclosure.
Figure 5:
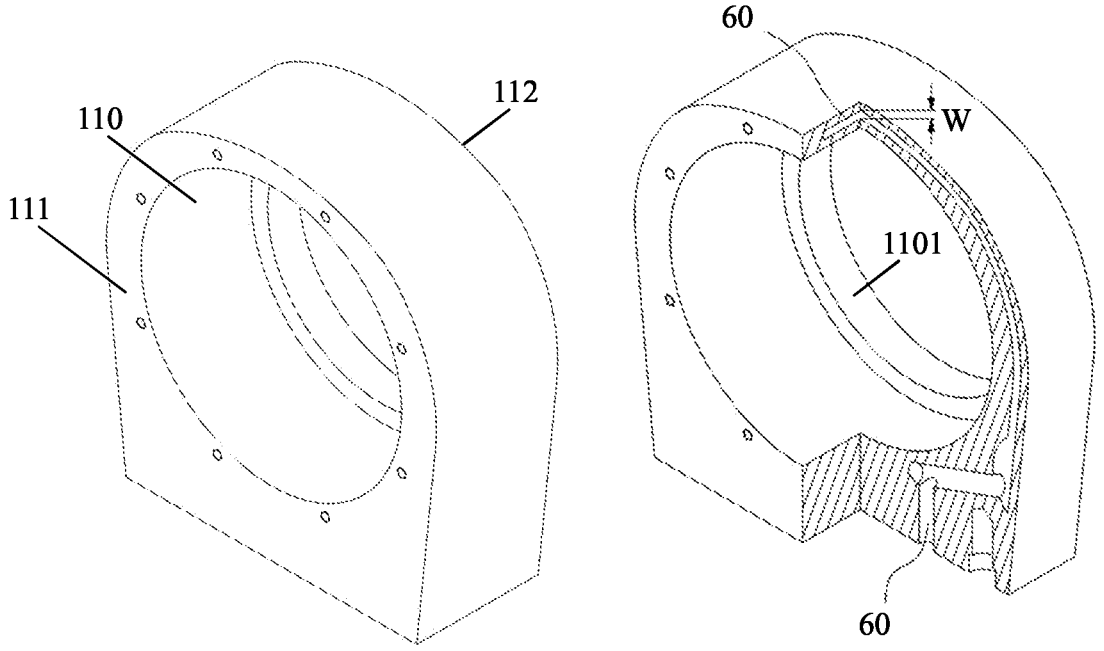
FIG. 5 is a schematic view of a preferred embodiment of a support unit housing according to the present disclosure.

Specifically, the housing 11 is used for accommodating the bearing and providing a support and mounting structure for the cover 161, the isolator 141 and other components. The housing 11 usually sits on a fixed surface (such as the ground or a mounting seat) and carries the weight from the continuous casting guide rolls and the slab. Referring further to FIGS. 3 and 5, the housing 11 has an inner hole 110, a first axial end face 111 and a second axial end face 112 opposite the first axial end face 111. The first cover 161 is connected to the first axial end face 111 of the housing 11, for example, by a plurality of bolts arranged in the circumferential direction. The first cover 161 may closely abut against the first axial end face 111.

The first isolator 141 (which comprise a physical body of material—an isolator body) is disposed between the first cover 161 and the roll shaft 30 to provide isolation of the bearing 12 and the like inside the support unit 10. In addition, the first isolator 141 may be disposed between the first cover 161 and the roll shaft 30 by any suitable means. For example, the first cover 161 may include a circumferential groove for accommodating the first isolator 141. It should be understood that, although the preferred embodiment shown in FIGS. 2-3 further includes a first sleeve 151 (described later) disposed between the first isolator 141 and the roll shaft 30, it should be understood that according to a preferred and simple embodiment of the present disclosure, the first sleeve 151 can be omitted, that is, the first isolator 141 can directly contact the inner hole of the first cover 161 and the surface of the roll shaft 30. It should also be understood that the term "isolation" used herein has a broad meaning, including not only providing a seal against lubricant, but also providing isolation against solid, gas, liquid, heat and/or pressure difference, between the internal space of the support unit and the external environment. Specifically, in the present invention, the first isolator 141 here and various isolators described later all have the following characteristics: 1. the isolator can fill the space at the mating gap of related components to eliminate any gap between components; 2. the isolator has a certain contact force with the isolated surface (the surface in contact with the isolator) to ensure close contact and hold between the isolator and related components; 3. the isolator can prevent solid, gas and liquid pollutants from both sides from flowing under a pressure difference.

The bearing 12 is arranged in the inner hole of the housing 11 to rotate with the roll shaft 30 and bear the weight of the roll shaft 30 and the slab thereon. According to the present disclosure, there is a volume of lubricant 13 between the bearing 12 and the first isolator 141, which is pre-filled and enclosed in the support unit. The lubricant 13 can be applied to the parts that need lubrication in advance during the assembly of the support unit 10 on the roll shaft 30, such as applied to the inner hole 110 of the housing 11, the inner space and surface of the bearing 12 and the inner surface of the first isolator 141.

The housing or cover of a conventional support module of the prior art must be provided with a channel that forms an inlet and outlet for the lubricant or an opening for installing additional lubrication nozzles or lubrication pipelines. In contrast, in the support unit according to the present disclosure, the housing and the first cover do not have any channels for entry and exit of the lubricant so that after the support unit is assembled to the continuous casting guide roll, the support unit forms an independent and enclosed structure. The rotating parts can be sufficiently lubricated only by the lubricant sealed therein in advance, and there is no need to supplement or update the lubricant inside the support unit so there is no need to install additional lubricating nozzles or lubricating pipelines on the housing or cover. Therefore, the previous belief that "lubricant must be continuously replenished and updated" in the prior art is overcome, the structure of the support unit is simplified, and the usage of lubricant is greatly reduced. Therefore, compared with the prior art, the support unit according to the present disclosure is particularly suitable for use in harsh environments such as continuous casting, and the support unit has a longer service life and lower industrial waste discharge.

According to the present disclosure, the support unit 10 includes only one cover, that is, a first cover 161 on the first axial end face 111 side of the housing 11. Preferably, and referring to FIGS. 3-4, the first cover 161 may include a radial flange 1611 and an axial flange 1612, and the radial flange 1611 of the first cover 161 may abut against the first axial end face 111 of the housing 11, and the axial flange 1612 of the first cover 161 extends into the inner hole 110 of the housing 11 and abuts against the inner circumferential surface of the inner hole 110 and the outer ring 121 of the bearing 12. On the other hand, on the second axial end face 112 side of the housing 11, as shown in FIGS. 3 and 5, the inner hole 110 has an inner hole end wall 1101 extending radially inward. The inner hole end wall 1101 may, for example, extend radially inward by an appropriate distance so that the inner hole end wall 1101 abuts against the outer ring 121 of the bearing 12. Thus, the support unit 10 provides a simple structure and can reliably position and hold the bearing 12.

Further, a second isolator 142 (second primary isolator) may be provided between the inner hole end wall 1101 and the roll shaft 30 to provide isolation for the bearing 12 and the like inside the support unit 10. For example, the second isolator 142 may be disposed between the second cover 162 and the roll shaft 30 by any suitable means. For example, the second cover 162 may include a circumferential groove for receiving the second isolator 142. It should be understood that although the preferred embodiment shown in FIGS. 2-3 further includes a second sleeve 152 (described later) provided between the second isolator 142 and the roll shaft 30, the second sleeve 152 can be omitted, that is, the second isolator 142 can directly contact the inner circumferential surface of the inner hole end wall 1101 and the surface of the roll shaft 30. Furthermore, there is also lubricant 13 between the bearing 12 and the second isolator 142, which is prefilled and sealed in the support unit 10. The lubricant 13 can be applied to the parts that need lubrication in advance during the assembly of the support unit 10 on the roll shaft 30, such as the inner hole 110 of the housing 11, the inner space and surface of the bearing 12, and the inner surface of the second isolator 142.

According to a preferred embodiment of the present disclosure, as mentioned above, the support unit 10 may include a first sleeve 151 and a second sleeve 152. Further preferably, the first sleeve 151 may have at least a part extending into the inner hole 110, that is, the first sleeve 151 may have a certain axial length, with a part extending into the inner hole 110 and another part extending out of the first cover 161. In case that the first sleeve 151 is arranged at the end of the roll shaft 30, the first sleeve 151 may further include a radial end wall extending in the radial direction and abutting against the end of the roll shaft 30 so that the first sleeve 151 can be reliably positioned and held relative to the roll shaft 30. Further preferably, a first shaft-sleeve isolator 1510 (for example, in a circumferential groove on the inner side of the first sleeve 151) may be further provided between the first sleeve 151 and the roll shaft 30 to isolate the axial gap between the first sleeve 151 and the roll shaft 30.

Similarly, the second sleeve 152 may have at least a portion extending into the inner hole 110, that is, the second sleeve 152 may have a certain axial length, with one portion extending into the inner hole 110 and the other portion extending out of the housing 11. Further preferably, a second shaft-sleeve isolator 1520 (for example, in a circumferential groove on the inner side of the second sleeve 152) can also be provided between the second sleeve 152 and the roll shaft 30 to isolate the axial gap between the second sleeve 152 and the roll shaft 30.

Further preferably, in the case where the first sleeve 151 and the second sleeve 152 are provided, the first sleeve 151 and the second sleeve 152 may be arranged to abut against the inner ring 122 of the bearing 12, as shown in FIGS. 2 and 3. So that the bearing 12 can be further positioned and held by the two sleeves 151 and 152. According to this structure, after the support unit 10 is assembled on the roll shaft 30, the first sleeve 151, the bearing 12 and the second sleeve 152 will rotate together with the roll shaft 30.

According to a further preferred embodiment of the present disclosure, a solution of isolating the gap between the housing 11 and the first cover 161 is also proposed. Referring to FIGS. 2-3 in particular, the support unit 10 may further include a first housing-cover isolator 1610, which is, for example, arranged at the intersection of a radial flange 1611 and an axial flange 1612 of the first cover 161, and abuts against the radial flange 1611 and the axial flange 1612 of the first cover 161 and abuts against the first axial end face 111 and the inner circumferential surface of the inner hole 110. Therefore, the first housing-cover isolator 1610 is an isolator with a substantially L-shaped cross section, which can isolate the gaps in the radial direction and the axial direction at the corner of the first cover 161 and the housing 11.

In other preferred embodiments not shown, simplification can also be made for the first housing-cover isolator. For example, the first housing-cover isolator can be a sheet isolator arranged between the first cover 161 and the first axial end face 111 (this solution is also applicable to the case that the first cover only has a radial flange without an axial flange); or, the first housing-cover isolator may be a cylindrical isolator disposed between the first cover 161 and the inner circumferential surface of the inner hole 110. That is, the first housing-cover isolator can only isolate the gap in the radial direction or the axial direction between the first cover and the housing, or it can also be set as two separate first housing-cover isolators that isolate the gap in both the radial direction and the axial direction.

Compared with the prior art in which there is no isolator between the housing and the cover, the first housing-cover isolator 1610 further isolates the gap between the housing and the first cover, ensuring the sufficient isolation of the internal components of the support unit 10 from the external environment and reducing the lubricant leakage from inside the support unit 10.

Figure 6:
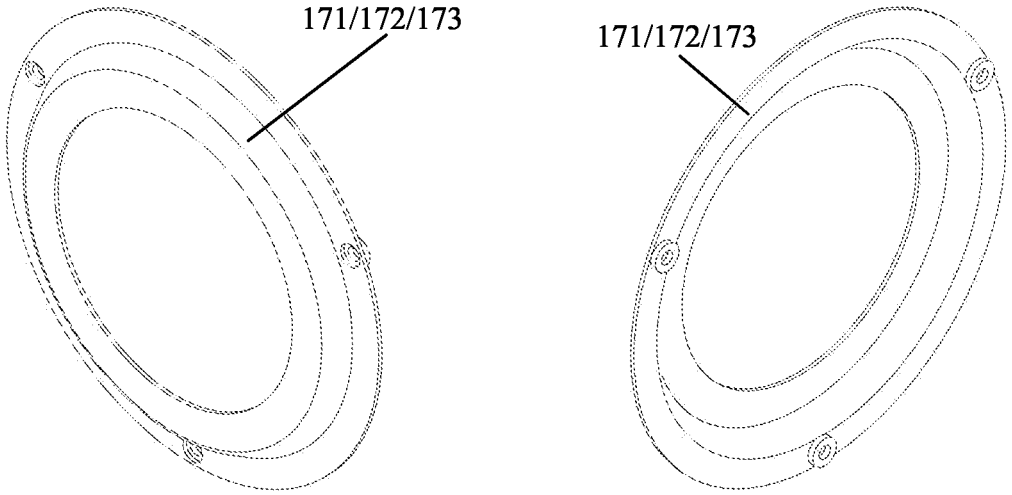
FIG. 6 is a schematic view of a preferred embodiment of a shield according to the present disclosure.

According to other preferred embodiments of the present disclosure, referring to FIGS. 2-3 and 6, the support unit 10 further includes a first shielding shroud 171, which is connected with the second axial end face 112 of the housing 11 (for example, by bolting). The first shielding shroud 171 may be sized to at least partially shield the housing 11 and the second isolator 142. By arranging such a first shielding shroud 171 on the outermost side of the support unit 10, heat, contaminants, water vapor and the like from the external environment can be preliminarily blocked and shielded.

According to other preferred embodiments of the present disclosure, as shown in FIGS. 2-3, the housing 11 may further include a cooling medium channel 60 at least partially circumferentially arranged inside the body of the housing so that the cooling medium can be introduced into the housing 11 from the outside, circulated in the cooling medium channel 60, and then discharged from the housing 11 to cool the support unit 10. The cooling medium channel 60 may have an appropriate radial width W to ensure the sufficient flow and heat exchange of the cooling medium inside the housing 11 while ensuring the strength of the housing 11. Since the cooling medium is usually corrosive, the inner surface of the cooling medium channel 60 may preferably include the protective coating 18. The protective coating 18 is coated on the surface in a liquid state, for example, by flow coating and spray coating, and dried and molded.

According to other preferred embodiments of the present disclosure, referring to FIG. 2, a protective coating 19 may be provided for the surface of the relevant component of the support unit 10 near the slab. For example, the protective coating 19 is at least partially coated on the outer circumferential surface of the housing 11. The protective coating 19 is coated on the surface in a semi-solid manner and dried and molded, for example. This protective coating 19 can at least reduce the heat transfer from the slab to the support unit 10, for example. More preferably, the protective coating 19 can also be formed to have a certain thickness and buffering property, so as to reduce the impact of large-volume debris on the support unit 10. In addition, although not shown, a protective coating 19 may be provided on the outer circumferential surface of the first cover 161. More preferably, the protective coating 19 may be coated on most circumferential surfaces of the housing 11 and the first cover 161, for example, except the bottom surface of the housing 11 and the surface of the first cover 16 covered by the end cover 301 (described later).

According to other preferred embodiments of the present disclosure, as shown in FIGS. 2-3, an end cover 301 may be provided at the end of the roll shaft 30. The end cover is arranged to abut against and be fixedly connected with the first axial end face 111 of the housing 11 and the first cover 161. The end cap 301 may include a cooling medium channel which communicates with a cooling medium channel 302 inside the roll shaft 30. Further, the housing 11 may include a channel 50 communicating with the cooling medium channel of the end cover 301.

The support unit 10 according to the present disclosure has been described above with reference to FIGS. 2-5. The support unit 20 according to the present disclosure also has basically the same structure as the support unit 10, and the differences between the two will be explained later, while the same or similar components in function or structure are given the same reference numerals and will not be described again.

Referring to FIG. 2, the housing 11 of the support unit 20 does not have an inner hole end wall on the side of the second axial end face, but has a second cover 162 connected to the second axial end face 112 of the housing 11. For example, the second cover 162 may have the same structure as the first cover 161 (see FIG. 5) to reduce the manufacturing cost. Furthermore, the support unit 20 further includes a second isolator 142, which is disposed between the second cover 162 and the roll shaft 30 to provide isolation for the bearing 12 and the like inside the support unit 20. There is lubricant 13 between the bearing 12 and the second isolator 142, which is pre-filled and enclosed in the support unit. The lubricant 13 can be applied to the parts to be lubricated in advance during the assembly of the support unit 20 on the roll shaft 30.

Preferably, the second isolator 142 may directly contact the inner circumferential surface of the second cover 162 and the surface of the roll shaft 30. Or, preferably, a second sleeve 152 may be provided between the second isolator 142 and the roll shaft 30. Similar to the bearing unit 10, in the bearing unit 20, the first sleeve 151 and the second sleeve 152 may also be arranged to abut against the inner ring of the bearing 12.

Further preferably, referring to FIG. 5, the second cover 162 may also include a radial flange 1621 and an axial flange 1622. The radial flange 1621 of the second cover 162 may abut against the second axial end face 112, and the axial flange 1622 of the second cover 162 may extend into the inner hole 110 of the housing 11 and abut against the inner circumferential surface of the inner hole 110 and the outer ring of the bearing 12.

Further preferably, a second cover isolator 1620 with a substantially L-shaped cross section can also be provided for the gap between the second cover 162 and the housing 11 in the support unit 20. Similar to the first housing-cover isolator 1610, as shown in FIG. 2, the second housing-cover isolator 1620 may be arranged at the intersection of the radial flange 1621 and the axial flange 1622 of the second cover 162, and abut against the radial flange 1621 and the axial flange 1622 of the second cover 162 and against the second axial end face of the housing 11 and the inner circumferential surface of the inner hole. In other preferred embodiments, not shown, the second cover isolator 1620 may be a sheet isolator disposed between the second cover 162 and the second axial end face, or a cylindrical isolator disposed between the second cover 162 and the inner circumferential surface of the inner hole.

According to other preferred embodiments of the present disclosure, referring to FIG. 2, the support unit 20 may include a second shielding shroud 172 and/or a third shielding shroud 173. The second shielding shroud 172 is connected with the axial outer end face of the first cover 161, for example, to at least partially shield the housing 11, the first cover 161, and the first isolator 141. The third shielding shroud 173 is connected with the axial outer end face of the second cover 162, for example, to at least partially shield the housing 11, the second cover 162, and the second isolator 142. In addition, in the support units 10 and 20, the connection parts of the first shielding shroud 171, the second shielding shroud 172 and the third shielding shroud 173 with the housing and the cover should be set as small as possible to minimize the heat transferred from the shielding shroud to the support units. In addition, the first shielding shroud 171, the second shielding shroud 172 and the third shielding shroud 173 as shown in FIG. 6 may be configured the same in order to reduce the manufacturing cost.

According to other preferred embodiments of the present disclosure, as shown in FIG. 2, the housing 11 of the support unit 20 may also include a cooling medium channel 60 arranged at least partially circumferentially and surroundingly in the housing body, and the inner surface of the cooling medium channel 60 may also preferably include a protective coating 18.

According to other preferred embodiments of the present disclosure, referring to FIG. 2, a protective coating 19 may be provided for the surfaces of relevant components of the support unit 20 which are near the slab, and the protective coating 19 is at least partially coated on the outer circumferential surfaces of the housing 11, the first cover 161 and the second cover 162 near the slab. Of course, it should be understood that the protective coating 19 may be provided only on the outer circumferential surface of one or both of the housing 11, the first cover 161 and the second cover 162. This protective coating 19 can at least reduce the heat transfer from the slab to the support unit 10, for example. More preferably, the protective coating 19 can also be formed to have a certain thickness and buffering property, so as to reduce the impact of large-volume debris on the support unit 20.

In addition, similar to the support unit 10, the housing 11, the first cover 161 and the second cover 162 of the support unit 20 do not have channels for lubricant to enter and exit. Lubricant in the support unit 20 is sealed therein in advance so there is no need to supplement or update the lubricant inside the support unit, and further there is no need to install additional lubrication nozzles or lubrication pipelines on the housing or cover.

It should be pointed out that various isolators used in the support unit according to the present disclosure can include elastic materials, which can continuously contact the surfaces of the housing, sleeve, cover, etc. to eliminate the gap between them, and can withstand the pressure difference between the two sides, prevent substantially all external contaminants including solid particles, liquid water and gaseous water vapor from entering the internal space of the support unit, and also substantially prevent the lubricant inside the support unit from leaking to the outside. These isolators can withstand pressure differences as high as 0.1 bar, 0.3 bar, 0.5 bar and 0.7 bar, for example.

The isolation component may be made of polymer elastic material with high temperature stability, which can continuously contact the surfaces of the housing, the sleeve and the cover to eliminate the gaps between them.

Furthermore, the present disclosure also provides a continuous casting guide roll assembly, which includes at least one support unit as described above. In the preferred embodiment shown in FIG. 2, the continuous casting guide roll assembly includes a support unit and a support unit 20 arranged on a roll shaft 30, and the support unit 10 is arranged at the end of the roll shaft 30, and the support unit 20 is arranged at the approximate middle position of the roll shaft 30. It should be understood that one support unit or more than two support units can be provided for the continuous casting guide roll according to actual needs.

The assembly method of the support units 10 and 20 according to the preferred embodiment shown in FIG. 2 will be briefly described below. In the following description, the relevant directions and orientations are for the drawing of FIG. 2.

Assembling the support unit 10 mainly includes: using tools to axially push the second isolator 142 into the inner hole 110 of the housing 11 and place it on the end wall 1101 of the inner hole, then axially pushing the second sleeve 152 into the second isolator 142 to fit them, and filling part of the lubricant 13 between the housing 11 and the second isolator 142; pushing the bearing 12 into the inner hole 110 of the housing 11 until the outer ring 121 of the bearing 12 abuts against the inner hole end wall 1101 of the housing 11 and the inner ring 122 abuts against the second sleeve 152; subsequently, filing the bearing 12 partially filled with lubricant 13 to cover the inner space and the rotating surface of the bearing 12. The first isolator 141 is assembled into the inner hole of the first cover 161 with tools, and then the first sleeve 151 is assembled into the inner hole of the first isolator 141 on the first cover 161 with tools so that the first cover 161, the first isolator 141 and the first sleeve 151 become a temporary assembly. Subsequently, lubricant 13 is applied to the surface of the first isolator 141 that is to face the bearing 12, and then this temporary assembly is installed in the inner hole of the housing 11 so that it abuts against the first axial end face 111 of the housing 11, and then the first cover 161 is tightly coupled with the housing 11 by bolts. Finally, the first shielding shroud 171 is installed on the housing 11 of the support unit 10 and connected by screws.

Assembling the support unit 20 mainly includes: assembling the first isolator 141 into the inner hole of the first cover 161 along the axial direction with tools and then assembling the first sleeve 151 into the inner hole of the first isolator 141 on the first cover 161 with tools so that the first cover 161, the first isolator 141 and the first sleeve 151 become a temporary assembly. Lubricant 13 is applied to the surface of the first isolator 141 that is to face the bearing 12, then this temporary assembly is installed into the inner hole of the housing 11 and abut against the first axial end face of the housing 11, and then the first cover 161 is tightly coupled with the housing 11 by bolts. Subsequently, the second isolator 141, the second cover 162 and the second sleeve 152 are assembled into a temporary assembly in a similar manner and steps, and the lubricant 13 is applied. These two temporary assemblies are installed in the inner hole of the housing 11 so that the first cover 161 and the second cover 162 abut against the two axial end faces of the housing 11, and then they are tightly coupled with bolts. Finally, the second shielding shroud 172 and the third shielding shroud 173 are respectively assembled on the first cover 161 and the second cover 162 of the support unit 20 and connected by screws.

The support units 10 and 20 are assembled to the continuous casting guide roll, and the support unit 10 should be assembled to the end of the roll shaft 30, while the support unit 20 should be assembled to the middle position of the roll shaft 30. The assembly process mainly includes: firstly, placing the roll shaft 30 and the support unit 20 on the workbench, adjusting their positions to align their centers, using a fixture press to push the roll shaft 30 through the sleeves 151 and 152 of the support unit 20 and the inner holes of the bearing 12 until reaching the proper axial position, and then through the roll body 40 on the roll shaft 30 in the same way; subsequently, assembling the support unit 10 on the roll shaft 30 again in a similar manner; and finally, assembling the end cover 301 on the axial outside of the support unit 10 communicating the housing 11 of the support unit 10, the roll shaft 30 and the coolant channel in the end cover 301.

Of course, it should be understood that the assembling method of the support unit and the assembling method of the support unit and the roll shaft need not be limited to the above steps and sequences, and after understanding the distance of the present disclosure, different steps and sequences can be adopted.

The exemplary implementation of the solution proposed in this disclosure has been described in detail above with reference to the preferable embodiments. However, it can be understood by those skilled in the art that without departing from the concept of this disclosure, various changes and modifications can be made to the above specific embodiments, and various technical features and structures proposed in this disclosure can be combined in various ways without exceeding the scope of protection of this disclosure, which is determined by the appended claims.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved support units and associated continuous casting guide roll assemblies.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

What is claimed is:

1. A support unit for a roll shaft of a continuous casting guide roll, comprising:

a housing having a first axial end face, a second axial end face and a through-opening extending from the first axial end face to the second axial end face;

a first cover connected to the first axial end face at a joint;

a first primary isolator body arranged radially between the first cover and the roll shaft; and a bearing in the through opening, wherein, on a first side of the bearing, a first closed space is partially defined by the bearing, the first cover, and the first primary isolator body, wherein the first closed space is pre-filled with a lubricant and sealed to prevent an entry of the lubricant into the closed space and an exit of the lubricant from the closed space.

2. The support unit according to claim 1, wherein the through-opening has a reduced-diameter portion at the second end face defining a radially inwardly facing cylindrical surface and a shoulder abutting against an outer ring of the bearing, wherein a second primary isolator is arranged radially between the cylindrical surface and the roll shaft, wherein on a second side of the bearing, a second closed space is at least partially defined by the bearing, the cylindrical surface and the second primary isolator, and wherein the second closed space is pre-filled with the lubricant.

3. The support unit according to claim 2, wherein the first cover comprises a radial flange and an axial flange, the radial flange abuts against the first axial end face, and the axial flange extends into the through opening and abuts against an inner circumferential surface of the through opening and against an outer ring of the bearing.

4. The support unit according to claim 3, including a first housing-cover isolator arranged at an intersection of the radial flange of the first cover and the axial flange of the first cover and abutting against the radial flange of the first cover and the axial flange of the first cover and against the first axial end face and the inner circumferential surface of the through-opening, the first housing-cover isolator isolating the first closed space from an external environment.

5. The support unit according to claim 4, further comprising:

a first sleeve arranged between the first primary isolator and the roll shaft and abutting against an inner ring of the bearing and extending into the through opening; and a second sleeve arranged between the second primary isolator and the roll shaft and abutting against the inner ring of the bearing and extending into the through opening;

a first shaft-sleeve isolator between the first sleeve and the roll shaft, and a second shaft-sleeve isolator between the second sleeve and the roll shaft.

6. The support unit according to claim 5, further comprising:

a first shielding shroud connected with the second axial end face of the housing to at least partially shield the housing and the second primary isolator;

a second shielding shroud connected with an axial outer end face of the first cover to at least partially shield the housing, the first cover and the first isolator; and a protective coating at least partially coated on an outer circumferential surfaces of the housing, the outer circumferential surfaces of the first cover and/or the outer circumferential surfaces of the second cover;

wherein the first and second primary isolators and the first and second housing-cover isolators and the first and second shaft-sleeve isolators provide isolation against solid, gas, liquid, heat and/or pressure difference between first and second closed spaces and an external environment.

7. A support unit for a roll shaft of a continuous casting guide roll, comprising:

a housing having a first axial end face, a second axial end face and a through-opening extending from the first axial end face to the second axial end face;

a first cover connected to the first axial end face;

a second cover connected to the second axial end face;

a first primary isolator arranged radially between the first cover and the roll shaft a second primary isolator arranged radially between the second cover and the roll shaft, and a bearing in the through opening, wherein, on a first side of the bearing, a first closed space is partially defined by the bearing, the first cover, and the first primary isolator, wherein the first closed space is pre-filled with a lubricant, wherein, on a second side of the bearing, a second closed space is at least partially defined by the bearing, the cylindrical surface and the second primary isolator, and wherein the second closed space is pre-filled with the lubricant.

8. The support unit according to claim 7, wherein:

the first cover comprises a radial flange and an axial flange, the radial flange abuts against the first axial end face, and the axial flange extends into the through opening and abuts against an inner circumferential surface of the through opening and against an outer ring of the bearing;

and/or wherein:

the second cover comprises a radial flange and an axial flange, the radial flange of the second cover abuts against the second axial end face, and the axial flange of the second cover extends into the through opening and abuts against the inner circumferential surface of the through opening and against the outer ring of the bearing.

9. The support unit according to claim 8, including:

a first housing-cover isolator arranged at an intersection of the radial flange of the first cover and the axial flange of the first cover and abutting against the radial flange of the first cover and the axial flange of the first cover and against the first axial end face and the inner circumferential surface of the through-opening, the first housing-cover isolator isolating the first closed space from an external environment; and/or a second housing-cover isolator arranged at an intersection of the radial flange of the second cover and the axial flange of the second cover and abutting against the radial flange of the second cover and the axial flange of the second cover and against the second axial end face and the inner circumferential surface of the through opening, the second housing-cover isolator isolating the second closed space from the external environment.

10. The support unit according to claim 9, further comprising:

a first sleeve arranged between the first primary isolator and the roll shaft and abutting against an inner ring of the bearing and extending into the through opening; and a second sleeve arranged between the second primary isolator and the roll shaft and abutting against the inner ring of the bearing and extending into the through opening;

a first shaft-sleeve isolator between the first sleeve and the roll shaft, and a second shaft-sleeve isolator between the second sleeve and the roll shaft.

11. The support unit according to claim 8, further comprising:

a first housing-cover isolator arranged between the first cover and the first axial end face or between the first cover and the inner circumferential surface of the through opening, the first housing-cover isolator isolating the first closed space from an external environment; and/or a second housing-cover isolator arranged between the second cover and the second axial end face or between the second cover and the inner circumferential surface of the through opening, and the second housing-cover isolator isolating the second closed space from the external environment.

12. The support unit according to claim 11, further comprising:

a first sleeve arranged between the first primary isolator and the roll shaft and abutting against an inner ring of the bearing and extending into the through opening; and a second sleeve arranged between the second primary isolator and the roll shaft and abutting against the inner ring of the bearing and extending into the through opening;

a first shaft-sleeve isolator between the first sleeve and the roll shaft, and a second shaft-sleeve isolator between the second sleeve and the roll shaft.

13. The support unit according to claim 7, further comprising:

a first shielding shroud connected with an axial outer end face of the first cover to at least partially shield the housing and the first primary isolator;

a second shielding shroud connected with an axial outer end face of the second cover to at least partially shield the housing, the second cover and the second primary isolator; and a protective coating at least partially coated on an outer circumferential surfaces of the housing, the outer circumferential surfaces of the first cover and/or the outer circumferential surfaces of the second cover;

wherein the first and second primary isolators and the first and second housing-cover isolators and the first and second shaft-sleeve isolators provide isolation against solid, gas, liquid, heat and/or pressure difference between first and second closed spaces and an external environment.

14. The support unit according to claim 13, wherein the housing further includes a cooling medium channel arranged at least partially circumferentially inside a body of the housing, an inner surface of the cooling medium channel including a protective coating; and/or the housing, the first cover and the second cover do not have channels for entry and exit of the lubricant.

15. A continuous casting guide roll assembly comprising:

a roll shaft of a continuous casting guide roll; and at least one support unit comprising a housing having a first axial end face, a second axial end face and a through-opening extending from the first axial end face to the second axial end face;

a first cover connected to the first axial end face;

a first primary isolator arranged radially between the first cover and the roll shaft and a bearing in the through opening, wherein, on a first side of the bearing, a first closed space is partially defined by the bearing, the first cover, and the first primary isolator, wherein the first closed space is pre-filled with a lubricant, and wherein the roll shaft extends completely through the through-opening such that a first portion of the roll shaft projects from a first end of the through-opening at the first axial end face and a second portion of the roll shaft projects from a second end of the through-opening at the second axial end face.

* * * * *